US010259028B2

(12) United States Patent
Ooyama et al.

(10) Patent No.: US 10,259,028 B2
(45) Date of Patent: Apr. 16, 2019

(54) DIRECT RESISTANCE HEATING METHOD AND PRESS-MOLDED PRODUCT MANUFACTURING METHOD

(71) Applicant: NETUREN CO., LTD., Tokyo (JP)

(72) Inventors: Hironori Ooyama, Tokyo (JP); Fumiaki Ikuta, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 349 days.

(21) Appl. No.: 15/315,925

(22) PCT Filed: Jul. 28, 2015

(86) PCT No.: PCT/JP2015/003771
§ 371 (c)(1),
(2) Date: Dec. 2, 2016

(87) PCT Pub. No.: WO2016/017147
PCT Pub. Date: Feb. 4, 2016

(65) Prior Publication Data

US 2017/0087615 A1 Mar. 30, 2017

(30) Foreign Application Priority Data

Jul. 28, 2014 (JP) ..... 2014-153370

(51) Int. Cl.
*B21D 22/02* (2006.01)
*C21D 1/40* (2006.01)
(Continued)

(52) U.S. Cl.
CPC ..... *B21D 22/022* (2013.01); *B21D 37/16* (2013.01); *C21D 1/40* (2013.01); *H05B 1/0236* (2013.01); *H05B 3/0004* (2013.01); *C21D 9/48* (2013.01)

(58) Field of Classification Search
CPC ..... B21D 22/022; B21D 37/16; C21D 1/40; C21D 9/48; H05B 1/0236; H05B 3/0004
See application file for complete search history.

(56) References Cited

U.S. PATENT DOCUMENTS

2014/0339210 A1 11/2014 Kobayashi et al.
2015/0173126 A1 6/2015 Ooyama et al.
2015/0208466 A1 7/2015 Ooyama et al.

FOREIGN PATENT DOCUMENTS

JP 2004-58082 2/2004
WO 2013/081180 6/2013
(Continued)

OTHER PUBLICATIONS

International Search Report dated Oct. 21, 2015 in International Application No. PCT/JP2015/003771.
(Continued)

*Primary Examiner* — Jenny R Wu
(74) *Attorney, Agent, or Firm* — Wenderoth, Lind & Ponack, L.L.P.

(57) ABSTRACT

In a direct resistance heating method, a current is applied to a plate workpiece having a varying cross-sectional area to heat the workpiece such that a high-temperature heating region and a non-high-temperature heating region are provided side by side. The method includes a preparation step of arranging a pair of electrodes on the workpiece, and a heating step of moving a first electrode from one end of the high-temperature heating region while applying a current to the pair of electrodes, stopping the movement of the first electrode when the first electrode reaches the other end of the high-temperature heating region, and stopping the current from being applied to the pair of electrodes when a predetermined time elapses after stopping the first electrode. A press-molded product manufacturing method includes
(Continued)

pressing the workpiece that has been heated by direct resistance heating method using a press die to perform hot press molding.

11 Claims, 8 Drawing Sheets

(51) Int. Cl.

| | |
|---|---|
| ***H05B 3/00*** | (2006.01) |
| ***B21D 37/16*** | (2006.01) |
| ***H05B 1/02*** | (2006.01) |
| *C21D 9/48* | (2006.01) |

(56) References Cited

FOREIGN PATENT DOCUMENTS

| | | |
|---|---|---|
| WO | 2013/180313 | 12/2013 |
| WO | 2014/025054 | 2/2014 |
| WO | 2014/061473 | 4/2014 |

OTHER PUBLICATIONS

Written Opinion of the International Searching Authority dated Oct. 21, 2015 in International Application No. PCT/JP2015/003771.

DIRECT RESISTANCE HEATING METHOD AND PRESS-MOLDED PRODUCT MANUFACTURING METHOD

TECHNICAL FIELD

The present invention relates to a direct resistance heating method of applying a current to a plate workpiece and a press-molded product manufacturing method using the direct resistance heating method.

BACKGROUND ART

Structures of a vehicle, for example, members requiring strength, such as various pillars and reinforcements are manufactured through heating. Heating is classified into indirect heating and direct heating. An example of the indirect heating is so-called furnace heating of inputting a workpiece into a furnace and heating the workpiece through control of the temperature of the furnace. On the other hand, examples of the direct heating include induction heating of heating a workpiece by supplying the workpiece with an eddy current and direct resistance heating of heating a workpiece by directly supplying the workpiece with a current.

A so-called tailored blank material in which characteristics are partially changed by joining different types of steel plates is used as a component of a vehicle body. For example, JP 2004-58082 A discloses a method of butt-welding ends of members having different materials or different thicknesses to each other and then performing press working.

However, as for the tailored blank material, it is necessary to butt-weld plural materials. The number of working processes increases and thus the tailored blank material is not suitable for mass production.

SUMMARY OF INVENTION

It is an object of the invention to provide a direct resistance heating method in which the number of working processes is small and which is suitable for mass production and a press-molded product manufacturing method using the direct resistance heating method.

According to an aspect of the present invention, a direct resistance heating method is provided. According to the direct resistance heating method, a current is applied to a plate workpiece, a cross-sectional area of which varying in a longitudinal direction of the plate workpiece, and the plate workpiece is heated such that a high-temperature heating region and a non-high-temperature heating region are provided side by side along the longitudinal direction. The direct resistance heating method includes a preparation step of arranging a pair of electrodes including a first electrode and a second electrode on the plate workpiece, and a heating step of moving the first electrode in the longitudinal direction from one end of the high-temperature heating region while applying a current to the pair of electrodes, stopping the movement of the first electrode when the first electrode reaches the other end of the high-temperature heating region, and stopping the current from being applied to the pair of electrodes when a predetermined time elapses after the stopping of the movement of the first electrode.

The direct resistance heating method may further include, after the heating step, a non-heating step of restarting the movement of the first electrode in the longitudinal direction and moving the first electrode to one end of a next high-temperature heating region for a transition to a next heating step.

In the heating step, at least one of the current applied to the pair of electrodes and a moving speed of the first electrode may be controlled such that the high-temperature heating region has a predetermined temperature distribution in the longitudinal direction.

The current applied to the pair of electrodes and a moving speed of the first electrode may be controlled in accordance with a variation of the cross-sectional area of the plate workpiece, and the current may be applied to the pair of electrodes in a state in which the movement of the first electrode is temporarily stopped at the other end of the high-temperature heating region, so as to compensate for a shortfall of an amount of heat with respect to the high-temperature heating region due to not applying the current to the pair of electrodes while moving the first electrode from the other end of the high-temperature heating region to the one end of the next high-temperature heating region.

The current applied to the pair of electrodes may be constant, a moving speed of the first electrode may be controlled in accordance with a variation of the cross-sectional area of the plate workpiece, and the predetermined time may be set based on a period of time required to move the first electrode from the other end of the high-temperature heating region to the one end of the next high-temperature heating region.

A moving speed of the first electrode may be constant, the current applied to the pair of electrodes may be controlled in accordance with a variation of the cross-sectional area of the plate workpiece, and the predetermined time may be set based on a period of time required to moving the first electrode from the other end of the high-temperature heating region to the one end of the next high-temperature heating region.

According to another aspect of the present invention, the direct resistance heating method includes arranging a pair of electrodes including the first electrode and the second electrode on the plate workpiece, moving the first electrode in the longitudinal direction from one end of the high-temperature heating region to the other end of the high-temperature heating region, stopping the current from being applied to the pair of electrodes at least while the first electrode is moving over the non-high-temperature heating region, and applying the current to the pair of electrodes in a state in which the movement of the first electrode is temporarily stopped at the other end of the high-temperature heating region, so as to compensate for a shortfall of an amount of heat with respect to the high-temperature heating region due to not applying the current to the pair of electrodes while moving the first electrode from the other end of the high-temperature heating region to one end of a next high-temperature heating region.

The current may stopped from being applied to the pair of electrodes in a section of the high-temperature heating region in which the cross-sectional area of the plate workpiece does not vary with respect to a position in the longitudinal direction.

According to another aspect of the present invention, a press-molded product manufacturing method is provided. The press-molded product manufacturing method includes heating a plate workpiece by the direct resistance heating method described above, and pressing the plate workpiece using a press die to perform hot press molding.

According to the invention, since the amount of heat per unit volume in the high-temperature heating region becomes greater than that in the non-high-temperature heating region by performing the heating step, the high-temperature heating region and the non-high-temperature heating region are formed in the longitudinal direction and mass production can be realized by relatively simple control. In addition, it is possible to easily manufacture a press-molded product.

DESCRIPTION OF EMBODIMENTS

Figure 1A:
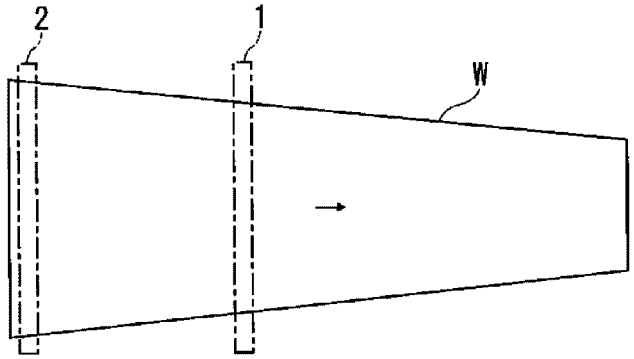
FIG. 1A is a plan view of a plate workpiece according to an embodiment of the present invention.

Hereinafter, embodiments of the invention will be described in detail with reference to the drawings.

Workpiece Example 1

A workpiece according to an embodiment of the present invention is a plate workpiece of which a cross-sectional area varies in a longitudinal direction thereof, that is, a cross-sectional area perpendicular to the longitudinal direction varies in the longitudinal direction. An example thereof is a steel sheet having a constant thickness and a width that monotonously decreases or increases along its longitudinal direction. In the following, description will be made in connection with a plate workpiece shown in FIG. 1A, i.e., a plate workpiece having a larger width on the left side than on the right side. In order to heat such a workpiece W by direct resistance heating, a first electrode 1 and a second electrode 2 are arranged at one end of a heating target region on the large-width side, and the electrodes 1 and 2 are connected to power supply equipment via wires. The supply current may be a DC current or an AC current. In the following description, the first electrode 1 is configured as a movable electrode and the second electrode 2 is configured as a fixed electrode, but both electrodes may be configured as movable electrodes as will be described later. The second electrode 2 is disposed at the left end having a large width and the first electrode 1 is disposed in the vicinity of the right side of the second electrode 2. Both the first electrode 1 and the second electrode 2 are longer than the width of a heating target region and are disposed to extend across the heating target region. The movable electrode is attached to a moving mechanism (not illustrated) and moves along the longitudinal direction in contact with the plate workpiece W.

As a reference example for explaining an embodiment of the invention, a direct resistance heating method when one heating target region to a high temperature is set in the plate workpiece W illustrated in FIG. 1A will be described. It is considered that a heating target region of the plate workpiece W is virtually partitioned as illustrated in FIG. 1C and the virtual segment regions are arranged in the longitudinal direction. The i-th segment region has a plate width, that is, a width in the depth direction, and has a distance ΔL (=L/n) which is obtained by dividing the distance L in the longitudinal direction into n sections. When a passage current when the movable electrode passes through the distance ΔL is defined as Ii and a current supply time is defined as ti, a temperature rise θi of the i-th segment region is determined depending on the total sum of energy supplied by the supply of current after the movable electrode passes through the section and is expressed by Equation (1). Here, i is a natural number from 1 to n.

[Math. 1]

$$\theta_i = \frac{\rho_e}{C\rho}\frac{1}{A_i^2}\sum_{i}^{n}(I_i^2 \times t_i) \tag{1}$$

Here, ρe denotes resistivity (Ω×m), ρ denotes a density (kg/m$^3$), C denotes specific heat (J/kg×° C.), and Ai denotes a cross-sectional area of the i-th segment region.

In order to make the temperatures of the sections constant when the resistivity, the specific heat, and the density of the plate workpiece are substantially in the same ranges, the current Ii and the current supply time ti in each section only have to be determined to satisfy a relationship expressed by Equation (2).

[Math. 2]

$$\frac{1}{A_1^2}\sum_{i=1}^{n}(I_i^2 \times t_i) = \frac{1}{A_2^2}\sum_{i=2}^{n}(I_i^2 \times t_i) = \ldots = \frac{1}{A_n^2}\sum_{i=n}^{n}(I_i^2 \times t_i) \tag{2}$$

That is, in order to uniformly heat the plate workpiece W, one or both of a current applied to a pair of electrodes including the first electrode 1 and the second electrode 2 and a speed of the movable electrode only have to be controlled such that an amount of heat per unit volume supplied through the supply of current after the movable electrode moves through a segment region for each segment region which is obtained by dividing the plate workpiece in the longitudinal direction.

In general, when a heating target region is divided into n sections in the longitudinal direction and each divided heating target region is wanted to have a certain temperature distribution, the following can be considered. That is, when the temperature of the i-th section is defined as θi and a temperature distribution thereof can be expressed by θi=f (xi), the current Ii and the current supply time ti in each section can be controlled to satisfy the following relationship.

[Math. 3]

$$\frac{1}{A_1^2}\sum_{i=1}^{n}(I_i^2 \times t_i) = f(x_1)$$

$$\frac{1}{A_2^2}\sum_{i=2}^{n}(I_i^2 \times t_i) = f(x_2)$$

$$\vdots$$

$$\frac{1}{A_n^2}\sum_{i=1}^{n}(I_i^2 \times t_i) = f(x_n)$$

Here, xi=ΔL×i is established, where i=1 to n.

When the moving speed of the electrode is constant, the current Ii can be set depending on the cross-sectional area Ai of each section. When the current Ii is constant, the moving speed of the electrode can be set depending on the cross-sectional area Ai of each section. The current Ii and the moving speed of the electrode may be set depending on the cross-sectional area Ai of each section. Here, The moving speed vi of the electrode in the i-th segment region Wi is defined by ΔL/ti. The movement of the electrode is stopped when the movable electrode moves to the n-th segment region and a current continues to be supplied by the time required for raising the temperature of the n-th segment region after the movement of the electrode is stopped, whereby the heating target region has a temperature distribution. Here, the expression of "have a temperature distribution" includes both a meaning of the same temperature range and a meaning of having a temperature gradient.

Figure 2A:
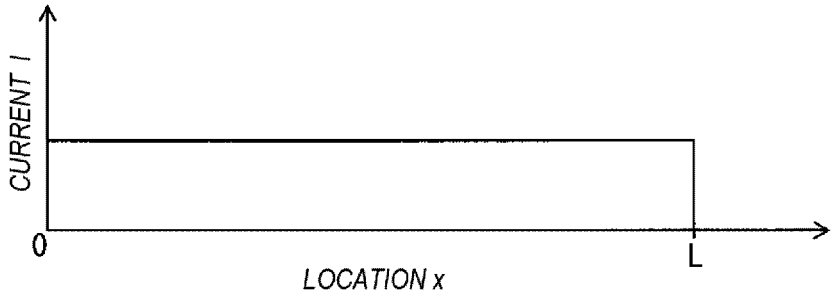
FIG. 2A is a diagram illustrating a current I with respect to a position in a longitudinal direction, in a case in which the plate workpiece has one high-temperature heating region heated by direct resistance heating such that a constant current is applied to a pair of electrodes and a moving speed of one of the electrodes is controlled.
Figure 2B:
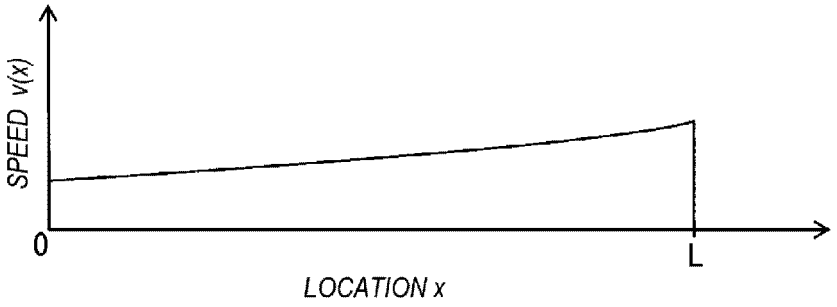
FIG. 2B is a diagram illustrating a speed v(x) of the moving electrode with respect to the position in the longitudinal direction.
Figure 2C:
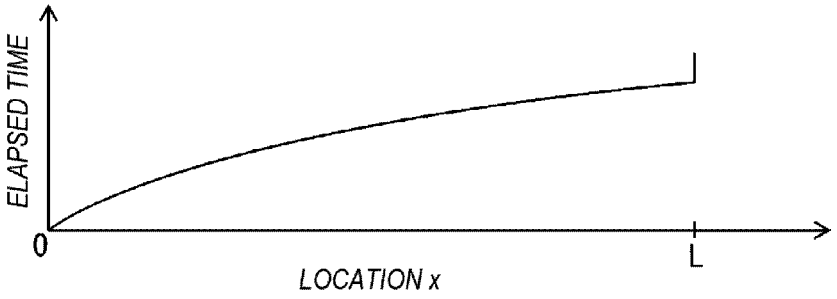
FIG. 2C is a diagram illustrating an elapsed time with respect to the position in the longitudinal direction.
Figure 2D:
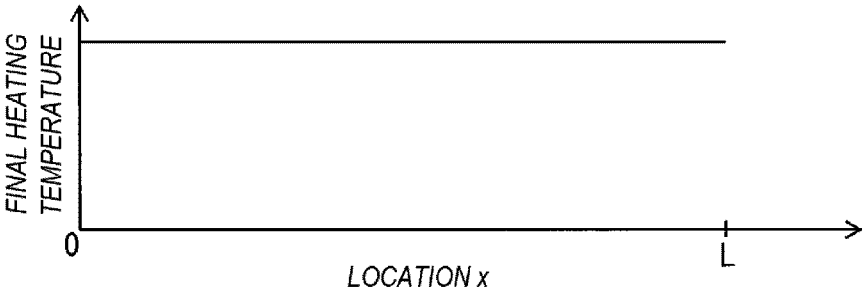
FIG. 2D is a diagram illustrating a final heating temperature with respect to the position in the longitudinal direction.

FIGS. 2A to 2D illustrate a direct resistance heating method in a case in which the plate workpiece has one high-temperature heating region, a constant current is applied to the pair of electrodes, and a moving speed of one of the electrodes is controlled. As illustrated in FIG. 2A, the current I with respect to a position in the longitudinal direction is kept constant, the moving speed of the first electrode 1 is made to vary to v(x) based on a variation in the cross-sectional area so as to satisfy Equation (2) and to increase as illustrated in FIG. 2B. Then, a relationship between an elapsed time from the current supply start and the position of the first electrode 1 is illustrated in FIG. 2C, and a final heating temperature is made to be uniform as illustrated in FIG. 2D, whereby the plate workpiece W is heated.

Figure 3A:
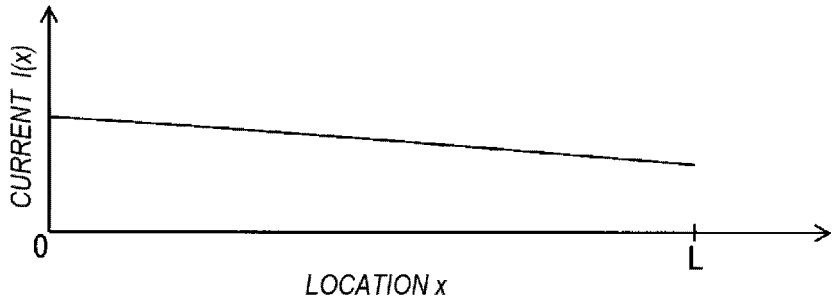
FIG. 3A is a diagram illustrating a current I with respect to a position in a longitudinal direction, in a case in which the plate workpiece has one high-temperature heating region heated by direct resistance heating such that a current applied to the pair of electrodes is controlled and one of the electrodes is moved at a constant speed.
Figure 3B:
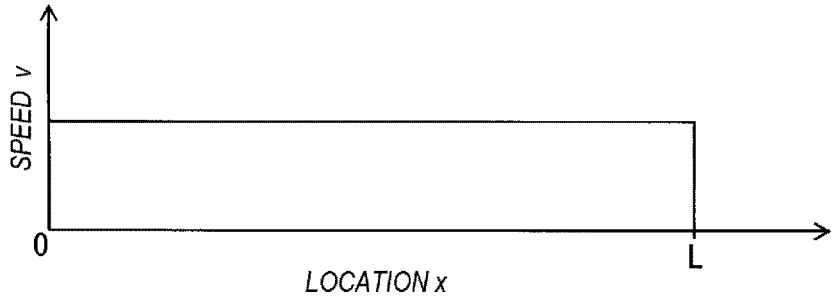
FIG. 3B is a diagram illustrating a speed v(x) of the moving electrode with respect to the position in the longitudinal direction.
Figure 3C:
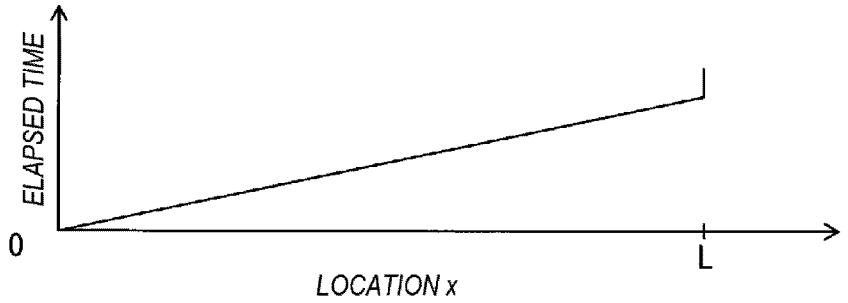
FIG. 3C is a diagram illustrating an elapsed time with respect to the position in the longitudinal direction.
Figure 3D:
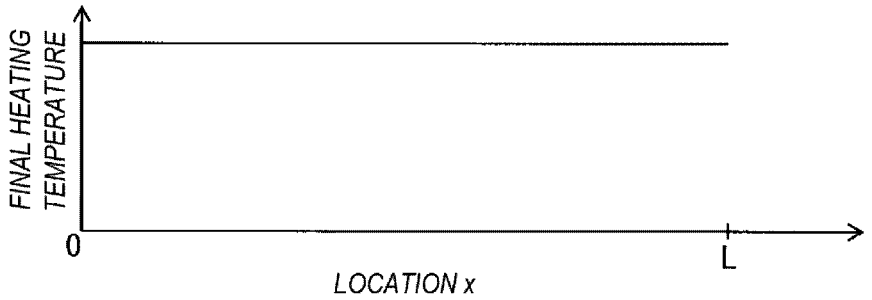
FIG. 3D is a diagram illustrating a final heating temperature with respect to the position in the longitudinal direction.

FIGS. 3A to 3D illustrate a direct resistance heating method in a case in which the plate workpiece has one high-temperature heating region, a current applied to the pair of electrodes is controlled, and the first electrode 1 is moved at a constant speed. As illustrated in FIG. 3B, the first electrode is moved at a constant speed v, the current I(x) supplied to the pair of electrodes is made to vary based on a variation in the cross-sectional area so as to satisfy Equation (2) and to decrease as illustrated in FIG. 3A. Then, a relationship between an elapsed time from the current supply start and the position of the first electrode 1 is illustrated in FIG. 3C, and a final heating temperature is made to be uniform as illustrated in FIG. 3D, whereby the plate workpiece W is heated.

Direct resistance heating method for plate workpiece having high-temperature heating region and non-high-temperature heating region The embodiment of the invention relates to a method of applying a current to a plate workpiece, a cross-sectional area of which varying in the longitudinal direction of the plate workpiece, and heating the plate workpiece such that a high-temperature heated region and a non-high-temperature heated region are provided side by side along the longitudinal direction. This direct resistance heating method is implemented by performing a preparation step and a heating step, and a high-temperature heated region and a non-high-temperature heated region are alternately provided along the longitudinal direction by performing a non-heating step.

In the preparation step, a pair of electrodes including a first electrode and a second electrode is arranged on a plate workpiece.

In the heating step, the first electrode is moved in the longitudinal direction while applying a current to the pair of electrodes in a state in which the first electrode is at one end of the high-temperature heating region, the movement of the electrode is temporarily stopped when the first electrode reaches the other end of the high-temperature heating region, and the current is stopped from being applied to the pair of electrodes when a predetermined time elapses after the movement of the electrode has stopped.

In the non-heating step, the movement of the first electrode in the longitudinal direction is restarted after the heating step, the first electrode is moved to one end of a next high-temperature heating region for a transition to the next heating step.

In the preparation step, the second electrode may be disposed on the large-width side of the high-temperature heating region and the first electrode may be disposed on the small-width side of the high-temperature heating region in the vicinity of the second electrode. Alternatively, the second electrode may be disposed on the large-width side of the non-high-temperature heating region, the first electrode may be disposed on the small-width side of the non-high-temperature heating region in the vicinity of the second electrode, and then the first electrode may move in the longitudinal direction to reach one end of the high-temperature heating region. That is, the first electrode and the second electrode may be disposed in the plate workpiece and at least any electrode may move to perform the heating step.

The predetermined time in the heating step is, for example, a period of time during which the first electrode moves from the other end of a high-temperature heating region to one end of the next high-temperature heating region in the non-heating step. In this time, a shortfall of an amount of heat caused by stopping the supply of current when the first electrode moves through a non-high-temperature heating region is supplemented. When the number of high-temperature heating regions is one, the predetermined time is set as a time in which the one area is heated to have a predetermined temperature distribution as a whole and an amount of heat required until the temperature rises to a predetermined temperature can be supplemented. The same is true when the number of high-temperature heating regions is two or more and when the movement of the electrode is stopped at the other end of the final high-temperature heating region. Here, the expression of "have a temperature distribution" includes both a meaning of the same temperature range and a meaning of having a temperature gradient.

Both of the current applied to the pair of electrodes and the moving speed of the first electrode may be variably controlled such that the amount of heat per unit volume given by the supply of current in each heating step is in the same range for each segment region in to which the plate workpiece W is divided in the longitudinal direction as illustrated in FIG. 1C, or may be controlled such that one of them is fixed and the other is variable. In general, one or both of the current applied to the pair of electrodes and the moving speed of the first electrode may be controlled such that the heating target region has a temperature in the same range in the longitudinal direction. Here, the temperature distribution includes both an equivalent temperature range and a certain temperature gradient.

Direct resistance heating method using constant current when plate workpiece has one non-high-temperature heating region between high-temperature heating regions An example in which the plate workpiece has one non-high-temperature heating region between high-temperature heating regions will be described. An x axis is set in the longitudinal direction of the plate workpiece W illustrated in FIGS. 1A to 1C and one end having a large width is set to x=0. A range of $x1 \leq x \leq x2$ is set as the non-high-temperature heating region. The supply of current is temporarily stopped when the first electrode 1 as the movable electrode is in the area of $x1 \leq x \leq x2$. FIGS. 4A to 4D are diagrams schematically illustrating a direct resistance heating method using a constant current when one non-high-temperature heating region is set in a plate workpiece W and high-temperature heating regions are set on both sides thereof and illustrating a current I, a speed v(x) of a movable electrode, an elapsed time, and a final heating temperature with respect to a position in the longitudinal direction.

Figure 4A:
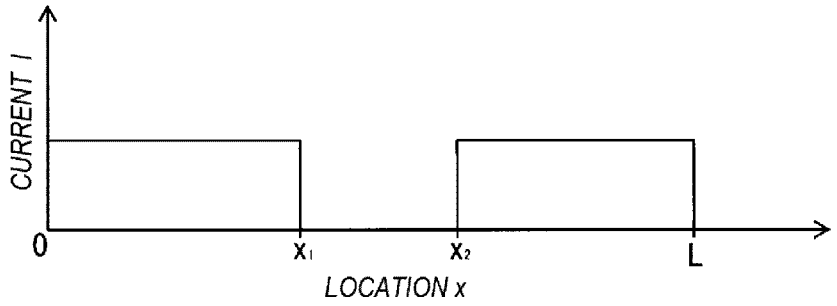
FIG. 4A is a diagram illustrating a current I with respect to a position in a longitudinal direction, in a case in which the plate workpiece has one non-high-temperature heating region between high-temperature heating regions heated by direct resistance heating such that a constant current is applied to the pair of electrodes.
Figure 4B:
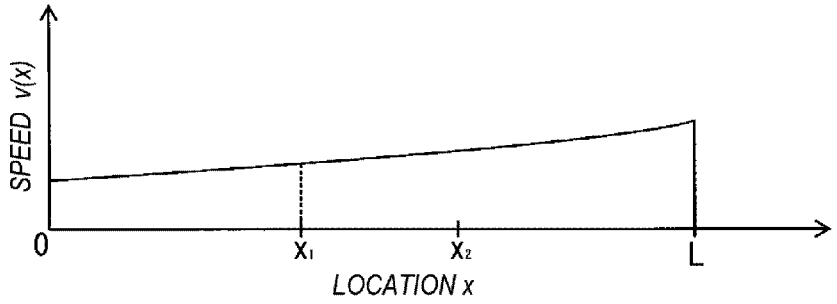
FIG. 4B is a diagram illustrating a speed v(x) of the moving electrode with respect to the position in the longitudinal direction.
Figure 4C:
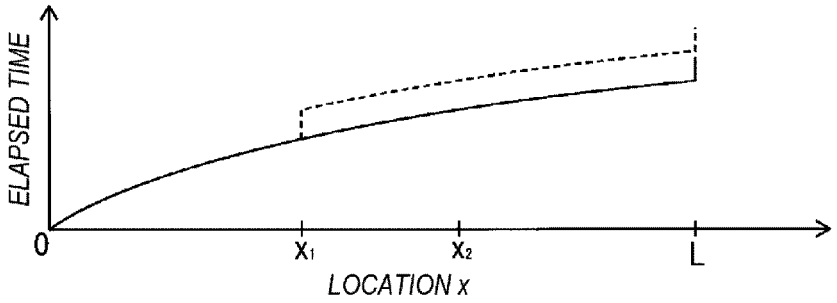
FIG. 4C is a diagram illustrating an elapsed time with respect to the position in the longitudinal direction.
Figure 4D:
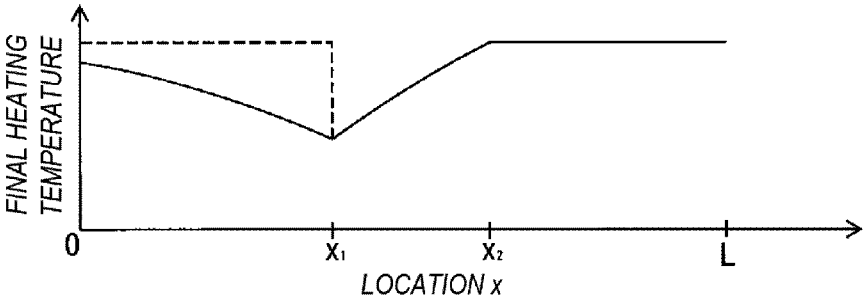
FIG. 4D is a diagram illustrating a final heating temperature with respect to the position in the longitudinal direction.

When the supply of current is stopped while the movable electrode moves from x=x1 to x=x2 as illustrated in FIG. 4A and the speed v(x) of the movable electrode and the elapsed time are set to the same as illustrated in FIGS. 2B and 2C as illustrated in FIGS. 4B and 4C, the area of $x2 \leq x \leq L$ is heated to a predetermined temperature, but the area of $0 \leq x \leq x1$ is not heated to the temperature indicated by a dotted line in FIG. 4D because the supply of current is stopped while the movable electrode moves from x=x1 to x=x2 and thus an amount of heat is not supplied in the period in which the supply of current is stopped.

Therefore, in order to prevent the area of $0 \leq x \leq x1$ of the plate workpiece W from not being heated to a predetermined high temperature, the movement of the movable electrode can be temporarily stopped by the time required for moving the movable electrode from x=x1 to x=x2 when the movable electrode reaches x=x1, a constant current I can be continuously supplied, then the supply of current can be temporarily stopped, the movable electrode can be moved from x=x1 to x=x2, and then the supply of constant current can be restarted.

That is, the movement of the movable electrode is temporarily stopped when the movable electrode reaches x=x1 and a constant current is supplied in a time in which the movable electrode hypothetically moves to x=x2 on the assumption that the moving speed v(x) varies depending on the variation in the cross-sectional area while the movable electrode moves from x=x1 to x=x2 and the movable electrode continuously moves at the moving speed v(x). Then, a deficient amount of heat in the area of $0 \leq x \leq x1$ of the plate workpiece W can be supplemented. The time until the supply of current is stopped after the movable electrode reaches x=x1 is set to a time required for compensating for a shortfall of the amount of heat in the area of $x \leq x1$ because the supply of current is stopped while the movable electrode moves from x=x1 to x=x2. At this time, the current applied to the pair of electrodes may vary.

Since the time until the movable electrode moves from x=x1 to x=x2 after the supply of current is temporarily stopped hardly affects the final heating temperature of the plate workpiece W, the movable electrode may move at an arbitrary speed.

Direct resistance heating method using electrode moving at constant speed when plate workpiece has one non-high-temperature heating region between high-temperature heating regions Different from the example of FIGS. 4A to 4D, a direct resistance heating using movement of the movable electrode at a constant speed will be described below. FIGS. 5A to 5D are diagrams illustrating a direct resistance heating method using movement of an electrode at a constant speed when one non-high-temperature heating region is set in a plate workpiece W and high-temperature heating regions are set on both sides thereof and illustrating a current I, a speed v of a movable electrode, an elapsed time, and a final heating temperature with respect to a position in the longitudinal direction.

Figure 5A:
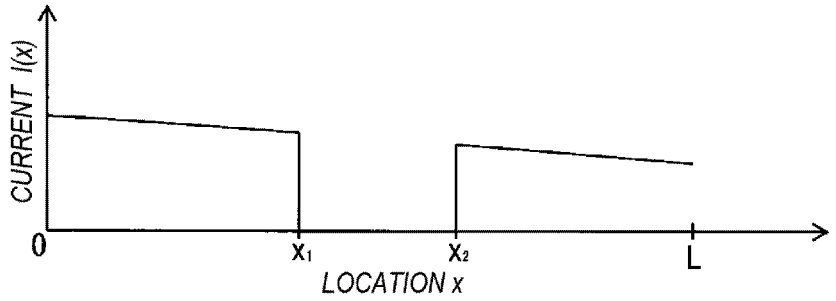
FIG. 5A is a diagram illustrating a current I with respect to a position in a longitudinal direction, in a case in which the plate workpiece has one non-high-temperature heating region between high-temperature heating regions heated by direct resistance heating such that one of the electrodes is moved at a constant speed.
Figure 5B:
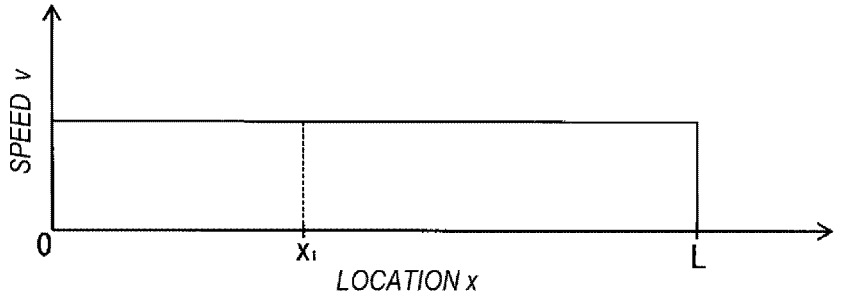
FIG. 5B is a diagram illustrating a speed v(x) of the moving electrode with respect to the position in the longitudinal direction.
Figure 5C:
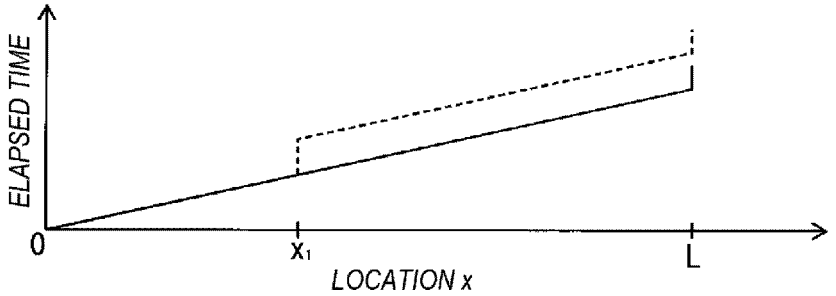
FIG. 5C is a diagram illustrating an elapsed time with respect to the position in the longitudinal direction.
Figure 5D:
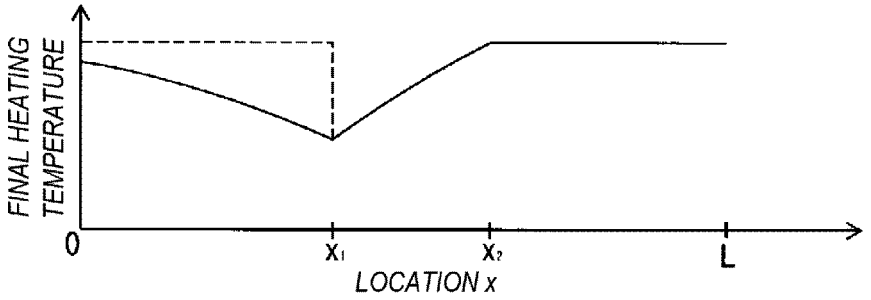
FIG. 5D is a diagram illustrating a final heating temperature with respect to the position in the longitudinal direction.

When the supply of current is stopped while the movable electrode moves from x=x1 to x=x2 as illustrated in FIG. 5A and the speed of the movable electrode and the elapsed time are set to the same as illustrated in FIGS. 3B and 3C as illustrated in FIGS. 5B and 5C, the area of x2≤x≤L is heated to a predetermined temperature, but the area 0≤x≤x1 is not heated to the temperature indicated by a dotted line in FIG. 5D because the supply of current is stopped while the movable electrode moves from x=x1 to x=x2 and thus an amount of heat is not supplied in the period in which the supply of current is stopped.

Therefore, in order to prevent the area of 0≤x≤x1 of the plate workpiece W from not being heated to a predetermined high temperature, a current is controlled and continuously supplied depending on the variation in the cross-sectional area on the assumption that the movable electrode moves at a constant speed v when the movable electrode reaches x=x1, and the movement of the electrode is temporarily stopped by the time required for moving the movable electrode from x=x1 to x=x2, that is, by the time required for moving the movable electrode at the speed v over the length in the longitudinal direction of the non-high-temperature heating region. Thereafter, the supply of current is temporarily stopped, the movable electrode moves from x=x1 to x=x2 at a constant speed v, and the supply of constant current is restarted. That is, the movement of the movable electrode is stopped at x=x1 and the current is controlled to satisfy Equation (2) when it is assumed that the movable electrode moves from x=x1 to x=x2. Then, it is possible to supplement the deficient amount of heat in the area of 0≤x≤x1 of the plate workpiece W. Since the operation of temporarily stopping the supply of current and moving the movable electrode from x=x1 to x=x2 hardly affects the final heating temperature of the plate workpiece W, the movable electrode may move at an arbitrary speed.

Direct resistance heating method using constant current when plate workpiece has two non-high-temperature heating regions each defined between high-temperature heating regions.

An example in which the plate workpiece W has two non-high-temperature heating regions each defined between high-temperature heating regions will be described. An area of x1≤x≤x2 and an area of x3≤x≤x4 are set as the non-high-temperature heating regions. The supply of current is temporarily stopped when the movable electrode is in the area of x1≤x≤x2 and the area of x3≤x≤x4. FIGS. 6A to 6D are diagrams schematically illustrating a direct resistance heating method using a constant current when two non-high-temperature heating regions are set in a plate workpiece W and high-temperature heating regions are set on both sides thereof and illustrating a current I, a speed v(x) of a movable electrode, an elapsed time, and a final heating temperature with respect to a position in the longitudinal direction.

Figure 6A:
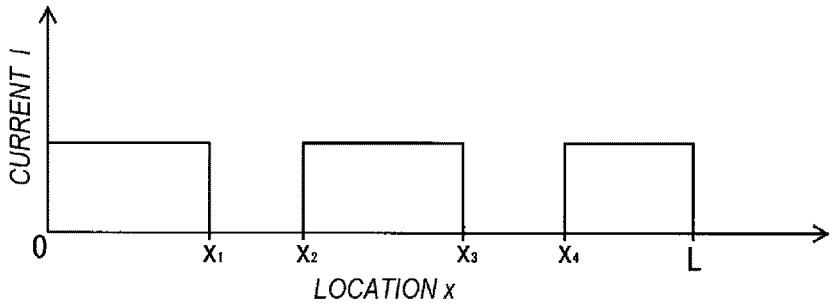
FIG. 6A is a diagram illustrating a current I with respect to a position in a longitudinal direction, in a case in which the plate workpiece has two non-high-temperature heating regions each defined between high-temperature heating regions heated by direct resistance heating such that a constant current is applied to the pair of electrodes.
Figure 6B:
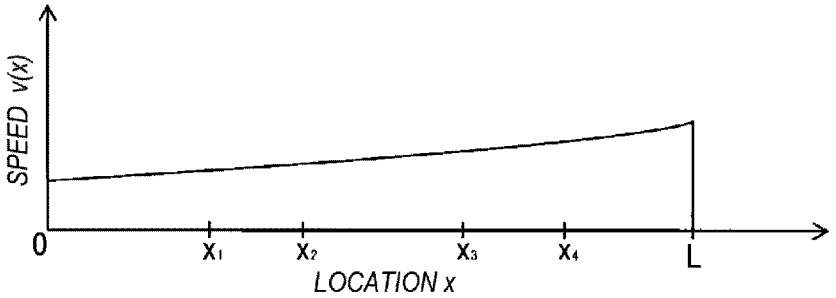
FIG. 6B is a diagram illustrating a speed v(x) of the moving electrode with respect to the position in the longitudinal direction.
Figure 6C:
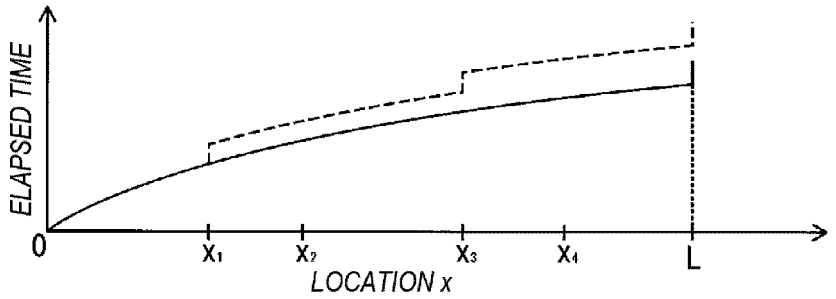
FIG. 6C is a diagram illustrating an elapsed time with respect to the position in the longitudinal direction.
Figure 6D:
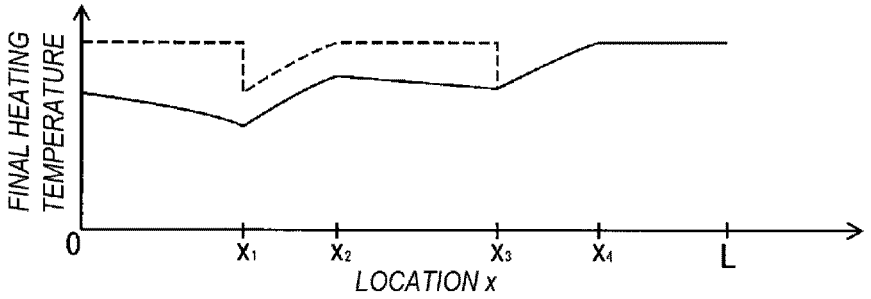
FIG. 6D is a diagram illustrating a final heating temperature with respect to the position in the longitudinal direction.

When the supply of current is stopped while the movable electrode moves from x=x1 to x=x2 and from x=x3 to x=x4 as illustrated in FIG. 6A and the speed v(x) of the movable electrode and the elapsed time are set to the same as illustrated in FIGS. 2B and 2C as illustrated in FIGS. 6B and 6C, the area of x4≤x≤L is heated to a predetermined temperature, but the area of 0≤x≤x1 is not heated to a predetermined high temperature because the supply of current is stopped while the movable electrode moves from x=x1 to x=x2 and from x=x3 to x=x4 and thus an amount of heat is not supplied in the period in which the supply of current is stopped. The area of x2≤x≤x3 is also not heated to a predetermined high temperature because the supply of current is stopped while the movable electrode moves from x=x3 to x=x4 and thus an amount of heat is not supplied in the period in which the supply of current is stopped.

Therefore, in order to prevent the area of 0≤x≤x1 of the plate workpiece W from not being heated to a predetermined high temperature, the movement of the movable electrode is temporarily stopped by the time required for moving the movable electrode from x=x1 to x=x2 when the movable electrode reaches x=x1, the constant current I is continuously supplied, then the supply of current is temporarily stopped, the movable electrode is moved from x=x1 to x=x2, and then the supply of constant current is restarted.

In order to prevent the area of x3≤x≤x4 of the plate workpiece W from not being heated to a predetermined high temperature, the movement of the movable electrode is temporarily stopped by the time required for moving the movable electrode from x=x3 to x=x4 when the movable electrode reaches x=x3, a constant current I is continuously supplied, then the supply of current is temporarily stopped, the movable electrode is moved from x=x3 to x=x4, and then the supply of constant current can be restarted. This is helpful to prevent the area of x1≤x≤x2 of the plate workpiece W from not being heated to a predetermined high temperature.

That is, the movement of the movable electrode is temporarily stopped when the movable electrode reaches x=x1 and the constant current I is supplied in a time in which the movable electrode hypothetically moves from x=x1 to x=x2 at the moving speed v(x). When the movable electrode reaches x=x3, the movement is temporarily stopped and the constant current I is supplied in a time in which the movable electrode hypothetically moves from x=x3 to x=x4 at the moving speed v(x). Then, a deficient amount of heat in the area of 0≤x≤x1 and the area of x3≤x≤x4 of the plate workpiece W can be supplemented. In general, the time in which a current is supplied at x=x1 and x=x3 without moving the movable electrode is determined to be a current and a time required for compensating for a shortfall of the supply of current to the high-temperature heating region while the movable electrode moves from x=x1 to x=x2 and from x=x3 to x=x4.

Direct resistance heating method using movement of electrode at constant speed when plate workpiece has two non-high-temperature heating regions each defined between high-temperature heating regions Different from the example of FIGS. 6A to 6D, a direct resistance heating using the movable electrode moving at a constant speed will be described below. FIGS. 7A to 7D are diagrams schematically illustrating a direct resistance heating method using movement of an electrode at a constant speed when two non-high-temperature heating regions are set in a plate workpiece W and high-temperature heating regions are set on both sides thereof and illustrating a current I(x), a speed v of a movable electrode, an elapsed time, and a final heating temperature with respect to a position in the longitudinal direction.

Figure 7A:
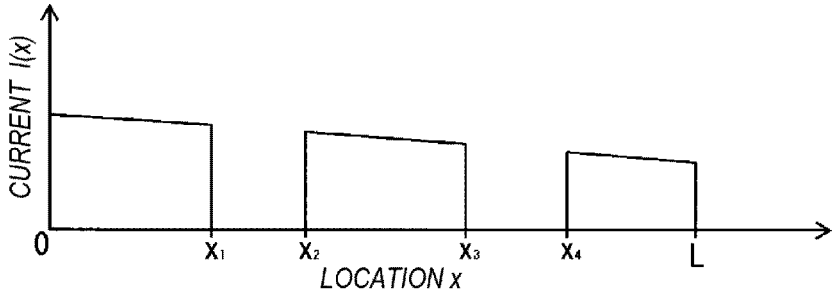
FIG. 7A is a diagram illustrating a current I with respect to a position in a longitudinal direction, in a case in which the plate workpiece has two non-high-temperature heating regions each defined between high-temperature heating regions heated by direct resistance heating such that one of the electrodes is moved at a constant speed.
Figure 7B:
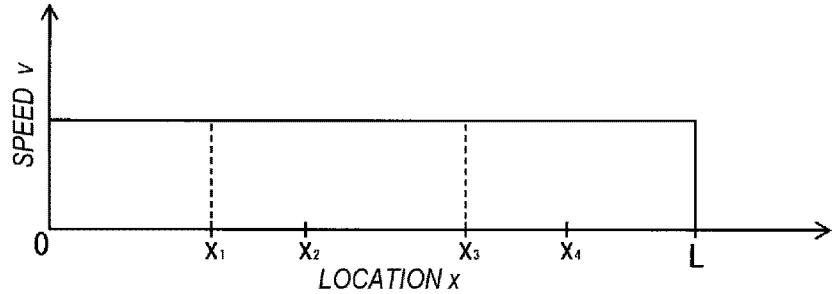
FIG. 7B is a diagram illustrating a speed v(x) of the moving electrode with respect to the position in the longitudinal direction.
Figure 7C:
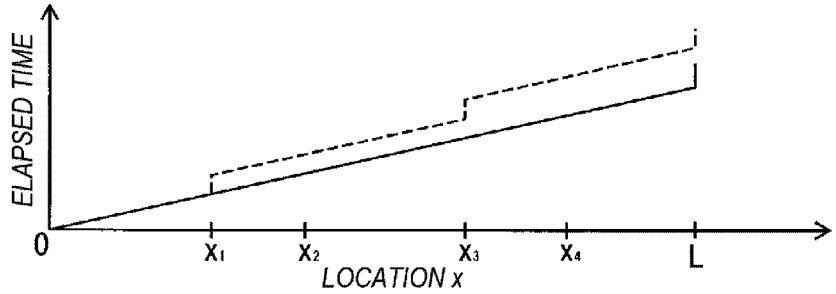
FIG. 7C is a diagram illustrating an elapsed time with respect to the position in the longitudinal direction.
Figure 7D:
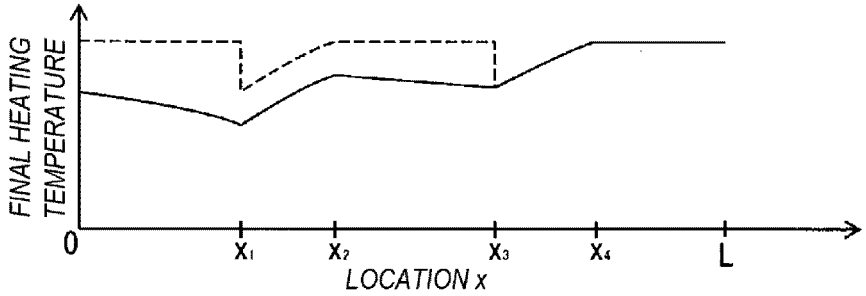
FIG. 7D is a diagram illustrating a final heating temperature with respect to the position in the longitudinal direction.

When the supply of current is stopped while the movable electrode moves from x=x1 to x=x2 and from x=x3 to x=x4 as illustrated in FIG. 7A and the speed v of the movable electrode and the elapsed time are set to the same as illustrated in FIGS. 3B and 3C as illustrated in FIGS. 7B and 7C, the area of x4≤x≤L is heated to a predetermined temperature, but the area of 0≤x≤x1 is not heated to a predetermined high temperature because the supply of current is stopped while the movable electrode moves from x=x1 to x=x2 and from x=x3 to x=x4 and thus an amount of heat is not supplied in the period in which the supply of current is stopped.

Therefore, in order to prevent the area of 0≤x≤x1 and the area of x2≤x≤x3 of the plate workpiece W from not being heated to a predetermined high temperature, a current is controlled and continuously supplied depending on the variation in the cross-sectional area on the assumption that the movable electrode moves at the constant speed v when the movable electrode reaches x=x1, and the movement of the movable electrode is temporarily stopped at x=x1 by the time required for moving the movable electrode from x=x1 to x=x2 at the speed v. Thereafter, the supply of current is temporarily stopped, the movable electrode is moved from x=x1 to x=x2 at the constant speed v, and then the supply of current based on the cross-sectional area is restarted at x=x2 when the movable electrode reaches x=x2.

Subsequently, when the movable electrode reaches x=x3, a current is controlled and continuously supplied depending on the variation in the cross-sectional area on the assumption that the movable electrode moves from x=x3 to x=x4 at the constant speed v, and the movement of the movable electrode is temporarily stopped at x=x3 by the time required for moving the movable electrode from x=x3 to x=x4 at the speed v. Thereafter, the supply of current is temporarily stopped, the movable electrode is moved from x=x3 to x=x4 at the constant speed v, and then the supply of current based on the cross-sectional area is restarted at x=x4 when the movable electrode reaches x=x4. This is helpful to prevent the area of x1≤x≤x2 of the plate workpiece W from not being heated to a predetermined high temperature.

That is, when the movable electrode reaches x=x1, the movement of the movable electrode is temporarily stopped and the current is continuously controlled and supplied depending on the variation in the cross-sectional area at an arbitrary position of the movable electrode in the time in which the movable electrode moves from x=x1 to x=x2 at the constant speed v. Thereafter, the supply of current is stopped, the movable electrode is moved from x=x1 to x=x2, and the supply of current based on the cross-sectional area is restarted when the movable electrode reaches x=x2. When the movable electrode reaches x=x3, the movement of the movable electrode is temporarily stopped and the current is continuously controlled and supplied depending on the variation in the cross-sectional area at an arbitrary position of the movable electrode in the time in which the movable electrode moves from x=x3 to x=x4 at the constant speed v. Thereafter, the supply of current is stopped, the movable electrode is moved from x=x3 to x=x4, and the supply of current based on the cross-sectional area is restarted when the movable electrode reaches x=x4. Then, a deficient amount of heat in the area of 0≤x≤x1 and the area of x2≤x≤x3 of the plate workpiece W can be supplemented. In general, the time in which a current is supplied at x=x1 and x=x3 without moving the movable electrode is determined to be a current and a time required for compensating for a shortfall of the supply of current to the high-temperature heating region while the movable electrode moves from x=x1 to x=x2 and from x=x3 to x=x4.

While two high-temperature heating regions are provided in the examples described above, the number of high-temperature heating regions may be more than two, in which case the heating step and the non-heating step can be sequentially repeated as described above.

Workpiece Example 2 and its Direct Resistance Heating Method

Figure 8:
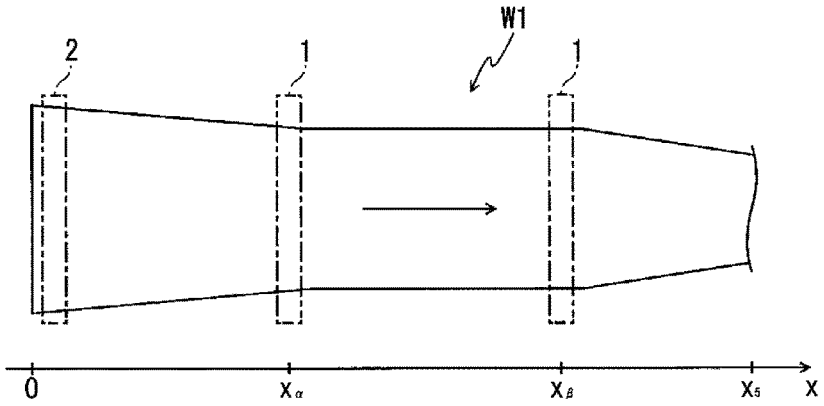
FIG. 8 is a plan view of a portion of a plate workpiece that is different from the plate workpiece of FIG. 1A.

A plate workpiece of which the cross-sectional area varies in the longitudinal direction or a plate workpiece in which the cross-sectional area does not vary in a certain section in the longitudinal direction can be subjected to direct resistance heating as follows. FIG. 8 is a plan view illustrating a part of a plate workpiece which is different from that illustrated in FIG. 1A. In a plate workpiece W1 in which the cross-sectional area does not vary in an area of xα≤x≤xβ because the workpiece has a constant thickness and the width does not vary in the area of xα≤x≤xβ as illustrated in FIG. 8, the following should be carried out when the area from x=0 to x=x5 is set as the high-temperature heating region. In the preparation step, a pair of electrodes of the first electrode 1 and the second electrode 2 is arranged at one end having a large-width of the high-temperature heating region and the electrodes 1 and 2 are connected to current supply equipment. Then, while controlling the moving speed and the supply current as described above for the pair of electrodes, the first electrode 1 is moved to x=xα and then the supply of current is temporarily stopped. The first electrode 1 is moved to x=xβ at an arbitrary speed and then the supply of current is restarted at the same speed as at x=xα in a state in which the first electrode 1 is located at x=xβ. Accordingly, even when a high-temperature heating region includes a portion in which the cross-sectional area does not vary, the workpiece can be heated in the same way as described above.

When a section in which the cross-sectional area does not vary is formed in the high-temperature heating region and the non-high-temperature heating region and the first electrode 1 moves in the order of the high-temperature heating region and the non-high-temperature heating region, the supply of current and the moving speed can be changed based on the above-mentioned concept. For example, the supply of current is temporarily stopped at a start position of a section in which the cross-sectional area does not vary in the high-temperature heating region, then the first electrode 1 is moved to the other end of the high-temperature heating region, the movement of the first electrode 1 is stopped at that position, and the same current as before the supply of current is stopped flows for a predetermined time. Here, the predetermined time is a time in which an amount of heat to be supplied to the high-temperature heating region and which has already been passed by the first electrode 1 on the assumption that the first electrode 1 moves to the next high-temperature heating region through the neighboring non-high-temperature heating region. Thereafter, the supply of current is stopped and the first electrode 1 is moved to one end of the next high-temperature heating region. The amount of current to be supplied as well as the predetermined time may be adjusted and the amount of heat to be originally supplied to the high-temperature heating region and which has already been passed by the first electrode 1 may be supplied.

On the other hand, when a section in which the cross-sectional area does not vary is formed in the non-high-temperature heating region and the high-temperature heating region and the first electrode 1 moves in the order of the non-high-temperature heating region and the high-temperature heating region, the supply of current and the moving speed can be changed based on the above-mentioned concept. For example, even when the first electrode 1 moves from the non-high-temperature heating region to the high-temperature heating region and reaches one end of the high-temperature heating region, the supply of current is not started until the section in which the cross-sectional area does not vary ends. When the electrode reaches the position at which the section in which the cross-sectional area does not vary ends in the high-temperature heating region, the supply of current is started.

Workpiece Example 3 and its Direct Resistance Heating Method

Figure 1B:
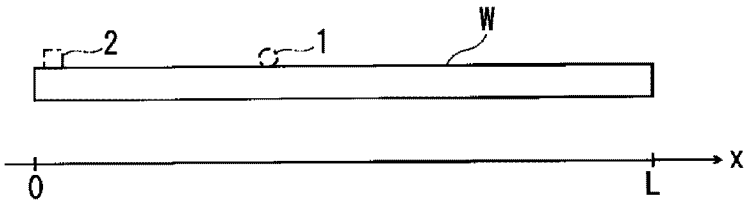
FIG. 1B is a front view of the plate workpiece.
Figure 1C:
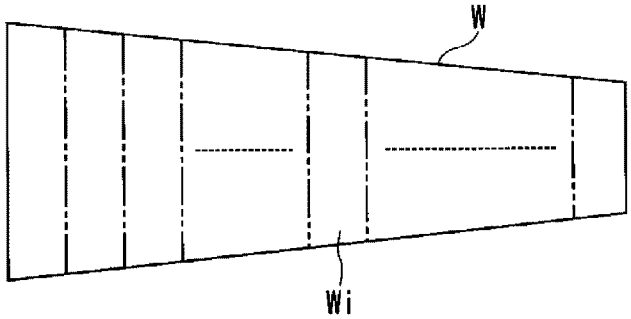
FIG. 1C is a diagram for illustrating a method of heating the plate workpiece by direct resistance heating method according to an embodiment of the present invention.
Figure 9A:
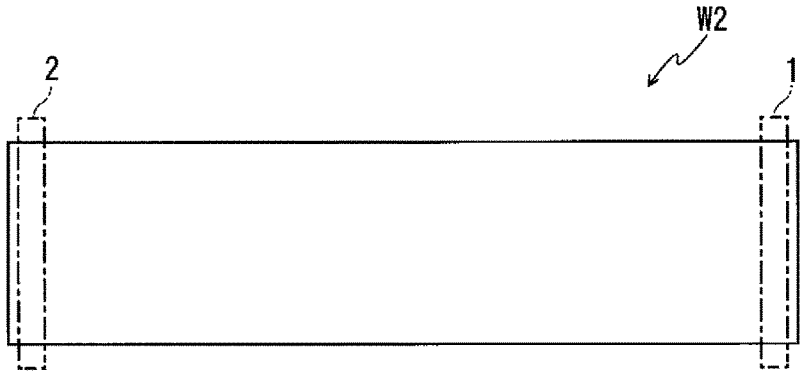
FIG. 9A is a plan view of a plate workpiece that is different from those of FIGS. 1A and 8.
Figure 9B:
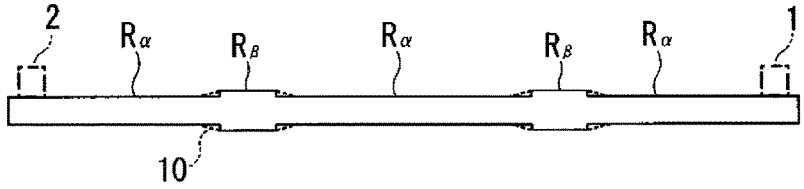
FIG. 9B is a front view of the plate workpiece of FIG. 9A.

FIG. 9A is a plan view of a plate workpiece which is different from those illustrated in FIGS. 1A and 8, and FIG. 9B is a front view thereof. As illustrated in FIG. 9A, a plate workpiece W2 is assumed in which the width of the plate workpiece W2 does not vary but is substantially constant in the depth direction and the width thereof varies in one or more sections. The thickness of the plate workpiece W2 is set to be great in the one or more sections in the horizontal direction, that is, the longitudinal direction and is set to be small in the other sections. That is, a thin-plate portion Rα and a thick-plate portion RPβ are alternately arranged and a thin-plate portion Rα is present at both ends. Accordingly, unevenness is formed along the longitudinal direction on at least one of the front surface and the rear surface of the plate workpiece W2. In FIG. 9B, the unevenness is excessively illustrated in comparison with the thickness.

When heating the plate workpiece W2 illustrated in FIGS. 9A and 9B by direct resistance heating, electrodes 1 and 2 are arranged at both ends of a heating target region, unlike the example of FIG. 1A. The electrodes 1 and 2 are longer than the width of the heating target region and are disposed to extend across the heating target region. The electrode 1 and the electrode 2 are connected to current supply equipment via wires. A current is supplied to the electrode 1 and the electrode 2 from the current supply equipment.

Then, in the plate workpiece W2 between the electrode 1 and the electrode 2, a current density is great in a portion in which the cross-sectional area perpendicular to the longitudinal direction is small and the current density is small in a portion in which the cross-sectional area is large. The amount of heat supplied to the portion having a large current density is greater than that of the portion having a small current density, and the temperature in the portion having a small current density is lower than that of the portion having a large current density.

Accordingly, a high-temperature heating region and a non-high-temperature heating region can be formed along the longitudinal direction of the plate workpiece W2 depending on the cross-sectional area.

That is, in an embodiment of the invention, the direct resistance heating method of arranging a high-temperature heating region and a non-high-temperature heating region in the longitudinal direction by applying a current to the plate workpiece W2, for example, alternately arranging the areas is realized by the following steps.

First, a plate workpiece W2 in which the cross-section in the longitudinal direction in the non-high-temperature heating region is set to be great is prepared.

Then, the first electrode 1 is disposed at one end of the heating target region of the plate workpiece W2 and the second electrode 2 forming a pair is disposed at the other end of the heating target region.

Then, a current is supplied to the first electrode 1 and the second electrode 2. Here, the current to be supplied may be a DC current or an AC current.

As indicated by a dotted line in FIGS. 9A and 9B, slope portiona slope portion 10 is preferably formed such that the unevenness in the plate workpiece W2 slowly varies. It is also preferable that the unevenness be formed on any one of the front surface and the rear surface of the plate workpiece W2. This is because even when the cross-sectional area of the plate workpiece W2 rapidly varies along the longitudinal direction, the current does not diffuse in the vicinity of the front and rear surfaces of the plate workpiece W2, an amount of current flowing in parallel to the longitudinal direction increases, and hardness uniformity in the portion having a large cross-sectional area is damaged.

According to the embodiments of the invention, a temperature of a high-temperature heating region is equal to or higher than Ac3 point and is, for example, equal to or higher than 850° C. A temperature of a non-high-temperature heating region is lower than, for example, Ac1 point and is, for example, equal to or lower than 730° C. After heating a plate workpiece by direct resistance heating, hot press molding can be performed by pressing the plate workpiece using a press die. Accordingly, the high-temperature heating region is a portion subjected to quenching and the non-high-temperature heating region is a portion not subjected to quenching. As a result, a plate having a portion having predetermined hardness and other portions can be manufactured using the same material without welding plate-like pieces formed of different materials or the like.

Modified Example

According to the embodiments described above, a high-temperature heating region and a non-high-temperature heating region are alternately defined in the longitudinal direction in the heating target region of the plate workpiece. The present invention may be applied also to a plate workpiece described below.

Figure 10:
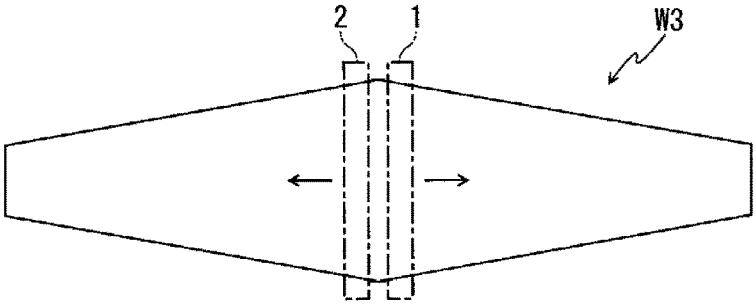
FIG. 10 is a plan view of a plate workpiece that is different from those illustrated in FIGS. 1A, 8, and 9A.

FIG. 10 is a plan view of a plate workpiece which is different from those illustrated in FIGS. 1A, 8, and 9A. The plate workpiece W3 illustrated in FIG. 10 has a shape in which a peak value is present in the variation of the cross-sectional area in the horizontal direction. For example, the thickness is constant and the width monotonously increases in the longitudinal direction and then monotonously decreases. When heating the plate workpiece W3 by direct resistance heating, the first electrode 1 and the second electrode 2 are arranged in a portion having a large width in a heating target region and the electrodes 1 and 2 are connected to current supply equipment using wires. Here, the current to be supplied may be a DC current or an AC current. In this embodiment, the first electrode 1 is used as a movable electrode and the second electrode 2 is also used as a movable electrode. The movable electrodes are attached to a moving mechanism (not illustrated) and move in the opposite directions along the longitudinal directions in contact with the plate workpiece W3.

The moving speed or the supplied current of each movable electrode is adjusted depending on the variation in the cross-sectional area as described above, and the amount of heat per unit volume supplied to each area, which is partitioned in the longitudinal direction, through the supply of current is in the same range. In an example, the speed of the electrode increases depending on the variation in the cross-sectional area, the electrode is stopped at one end of a high-temperature heating region and the constant current I is continuously supplied when the movable electrode reaches the end of the high-temperature heating region, the supply of current is temporarily stopped, the movable electrode is moved to an end of the next high-temperature heating region, and the supply of current is restarted. In another example, the current is controlled in accordance with the variation in the cross-sectional area while moving the movable electrode at a constant speed, the electrode is stopped at an end of a high-temperature heating region and the current is continuously controlled and supplied in the same way as described in the above-mentioned embodiments when the movable electrode reaches the end of the high-temperature heating region, then the supply of current is temporarily stopped, the movable electrode is moved to an end of the next high-temperature heating region, and then the supply of current is restarted.

In the embodiments of the invention, in the heating step, the high-temperature heating region and the non-high-temperature heating region can be alternately provided by controlling one or both of the current applied to the pair of electrodes and the moving speed of the first electrode such that the high-temperature heating region has a predetermined temperature distribution in the longitudinal direction. Here, the temperature may vary depending on the areas in which are heated to a high temperature or the high-temperature heating region may have a temperature distribution. When achieving the same temperature within each high-temperature heating region, one or both of the current applied to the pair of electrodes and the moving speed of the first electrode may be controlled such that the amount of heat per unit volume supplied to each segment region, in to which the plate workpiece is divided in the longitudinal direction, is in the same range.

In the embodiments of the invention, the current applied to the pair of electrodes and the moving speed of the first electrode are controlled in accordance with the variation of the cross-sectional area of the plate workpiece. When the first electrode is moved to a high-temperature heating region, the movement of the first electrode is temporarily stopped at the other end of the high-temperature heating region and the pair of electrodes is supplied with a current so as to compensate for a shortfall of the amount of heat due to non-supply of a current to the pair of electrodes while the first electrode moves from the other end of the high-temperature heating region to one end of the next high-temperature heating region. Accordingly, when the first electrode moves in the non-high-temperature heating region, it is possible to compensate for the shortfall of the amount of heat due to non-supply of a current.

EXAMPLES

A plate workpiece having an isosceles trapezoid in a plan view which contains 0.2% of carbon as a material and which has a length L of 500 mm, a thickness of 0.6 mm, a width of 100 mm on one side, and a width of 200 mm on the other side was prepared. A fixed electrode was disposed at one end having a large width and a movable electrode was disposed inside the fixed electrode. An effective current at an AC current of 50 Hz was set to be constant at 2600 A while moving the movable electrode at a speed v(x) satisfying Equation (2). Here, x=0 was set at one end having a small width of the plate workpiece and the large-width side of the plate workpiece was defined as the positive direction of the x axis. The unit was mm. The high-temperature heating region was set to $110 \leq x \leq 200$, $300 \leq x \leq 350$, and $450 \leq x \leq 500$. The time from the heating start to the final heating end was 16.8 seconds.

The final heating temperature at each position on the x axis was measured using a thermos-camera. The temperature-measuring position was almost the center in the depth direction. The final heating temperature was 783.3° C. at x=90 mm, 860.1° C. at x=110 mm, 953.3° C. at x=130 mm, 684.4° C. at x=205 mm, 703.5° C. at x=250 mm, 905.2° C. at x=305 mm, 953° C. at x=325 mm, 693.5° C. at x=355 mm, 720.3° C. at x=400 mm, 897.3° C. at x=455 mm, and 918.7° C. at x=490 mm.

From the above-mentioned test result, it could be seen that a high-temperature heating region and a non-high-temperature heating region could be alternately formed along the longitudinal direction in a plate workpiece formed of a single material.

This application is based on Japanese Patent Application No. 2014-153370 filed on Jul. 28, 2014, the entire content of which is incorporated herein by reference.

The invention claimed is:

1. A direct resistance heating method in which a current is applied to a plate workpiece, a cross-sectional area of which varying in a longitudinal direction of the plate workpiece, and the plate workpiece is heated such that a high-temperature heating region and a non-high-temperature heating region are provided side by side along the longitudinal direction, the direct resistance heating method comprising:

a preparation step of arranging a pair of electrodes including a first electrode and a second electrode on the plate workpiece; and a heating step of moving the first electrode in the longitudinal direction from one end of the high-temperature heating region while applying a current to the pair of electrodes, stopping the movement of the first electrode when the first electrode reaches the other end of the high-temperature heating region, and stopping the current from being applied to the pair of electrodes when a predetermined time elapses after the stopping of the movement of the first electrode.

2. The direct resistance heating method according to claim 1, further comprising, after the heating step, a non-heating step of restarting the movement of the first electrode in the longitudinal direction and moving the first electrode to one end of a next high-temperature heating region for a transition to a next heating step.

3. The direct resistance heating method according to claim 1, wherein, in the heating step, at least one of the current applied to the pair of electrodes and a moving speed of the first electrode is controlled such that the high-temperature heating region has a predetermined temperature distribution in the longitudinal direction.

4. The direct resistance heating method according to claim 2, wherein the current applied to the pair of electrodes and a moving speed of the first electrode are controlled in accordance with a variation of the cross-sectional area of the plate workpiece, and wherein the current is applied to the pair of electrodes in a state in which the movement of the first electrode is temporarily stopped at the other end of the high-temperature heating region, so as to compensate for a shortfall of an amount of heat with respect to the high-temperature heating region due to not applying the current to the pair of electrodes while moving the first electrode from the other end of the high-temperature heating region to the one end of the next high-temperature heating region.

5. The direct resistance heating method according to claim 2, wherein the current applied to the pair of electrodes is constant, a moving speed of the first electrode is controlled in accordance with a variation of the cross-sectional area of the plate workpiece, and the predetermined time is set based on a period of time required to move the first electrode from the other end of the high-temperature heating region to the one end of the next high-temperature heating region.

6. The direct resistance heating method according to claim 2, wherein a moving speed of the first electrode is constant, the current applied to the pair of electrodes is controlled in accordance with a variation of the cross-sectional area of the plate workpiece, and the predetermined time is set based on a period of time required to moving the first electrode from the other end of the high-temperature heating region to the one end of the next high-temperature heating region.

7. The direct resistance heating method according to claim 1, wherein the current is applied to the pair of electrodes in a state in which the movement of the first electrode is temporarily stopped at the other end of the high-temperature heating region, so as to compensate for a shortfall of an amount of heat with respect to the high-temperature heating region due to not applying the current to the pair of electrodes while moving the first electrode from the other end of the high-temperature heating region to one end of a next high-temperature heating region.

8. The direct resistance heating method according to claim 1, wherein the current is stopped from being applied to the pair of electrodes in a section of the high-temperature heating region in which the cross-sectional area of the plate workpiece does not vary with respect to a position in the longitudinal direction.

9. A press-molded product manufacturing method comprising heating a plate workpiece by the direct resistance heating method according to claim 1, and pressing the plate workpiece using a press die to perform hot press molding.

10. The direct resistance heating method according to claim 7, wherein the current is stopped from being applied to the pair of electrodes in a section of the high-temperature heating region in which the cross-sectional area of the plate workpiece does not vary with respect to a position in the longitudinal direction.

11. A press-molded product manufacturing method comprising heating a plate workpiece by the direct resistance heating method according to claim 7, and pressing the plate workpiece using a press die to perform hot press molding.

* * * * *